United States Patent [19]

Jager

[11] Patent Number: 5,004,198

[45] Date of Patent: Apr. 2, 1991

[54] FIXTURE-MOUNTING POST AND ASSEMBLY METHOD THEREFOR

[75] Inventor: Paul A. Jager, Muskegon, Mich.

[73] Assignee: Interior Specialists Corporation, Spring Lake, Mich.

[21] Appl. No.: 489,360

[22] Filed: Mar. 6, 1990

[51] Int. Cl.[5] ..... E04G 5/06; A47G 29/02

[52] U.S. Cl. ..... 248/225.1; 248/243

[58] Field of Search ..... 248/125, 221.4, 223.4, 248/225.1, 219.4, 241, 243, 345.1, 915; 211/153, 183, 187, 193

[56] References Cited

U.S. PATENT DOCUMENTS

| | | | |
|---|---|---|---|
| 4,585,131 | 4/1986 | Crossman | 211/206 |
| 4,711,420 | 12/1987 | Cowper | 248/243 |
| 4,886,235 | 12/1989 | Thonborrow | 248/225.1 |

*Primary Examiner*—Robert L. Wolfe

*Attorney, Agent, or Firm*—Dressler, Goldsmith, Shore, Sutker & Milnamow, Ltd.

[57] ABSTRACT

A fixture-mounting post useful to mount one or more fixtures. An elongate member defines fixture-mounting means comprising two oppositely facing longitudinal arrays of fixture-mounting slots. An elongate shroud having two protions is disposed around the elongate member. For each array of slots, two elongate edges of the shroud extend between both ends of the shroud and are spaced from each other to permit access to such array. A sleeve encloses a portion of the shroud at one end. A strip of resiliently compressible material is wrapped at least partly around the member and is compressed between the member and the enclosed portion of the shroud. A tight fit thus is effected between the enclosed portion of the shroud and the sleeve to secure the shroud to the sleeve. A method of assembling the post is also described.

23 Claims, 1 Drawing Sheet

FIG. 1
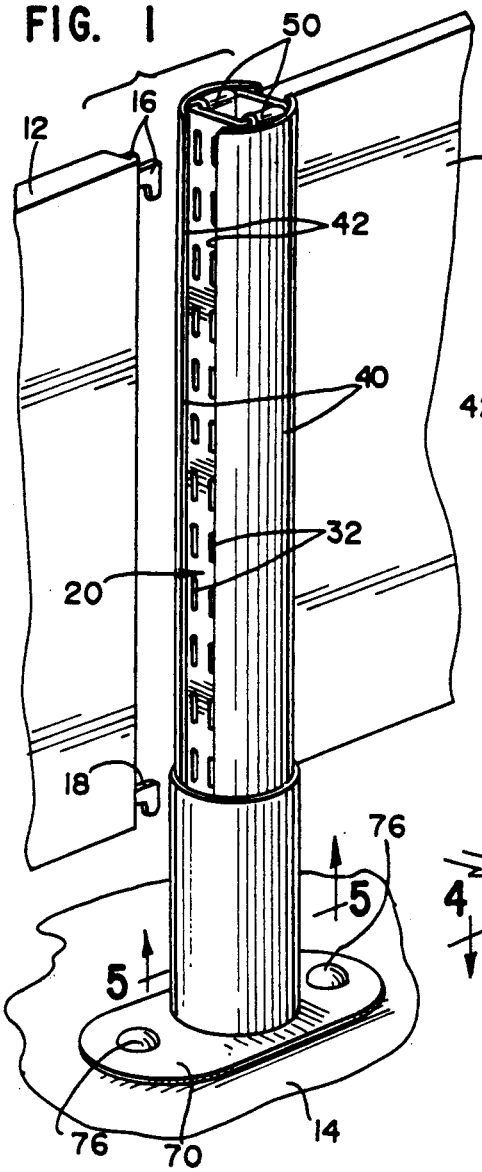
FIG. 2
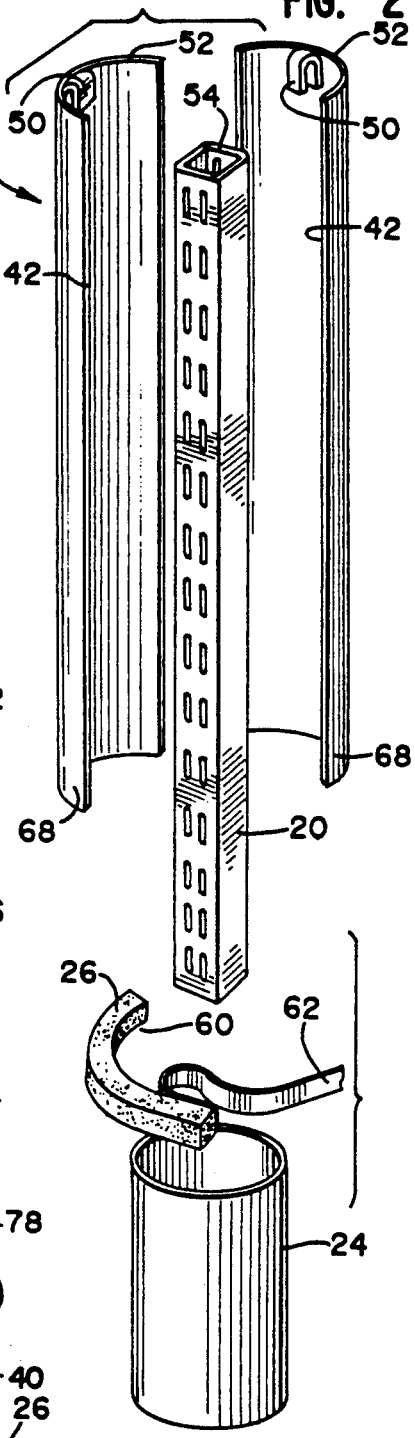
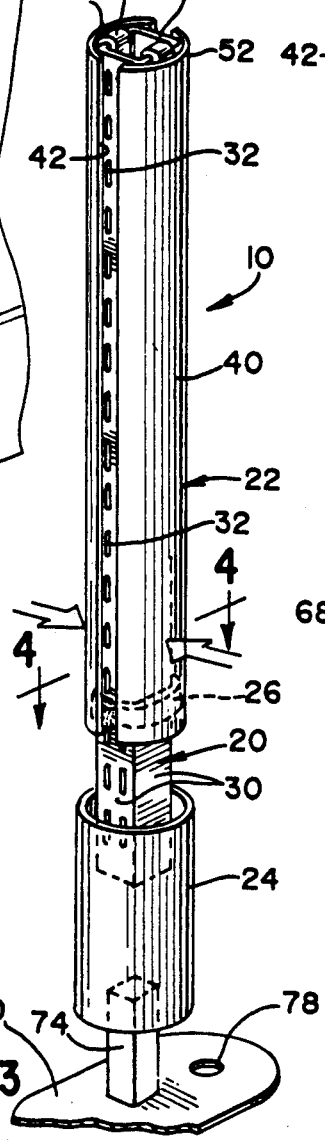
FIG. 3
FIG. 4
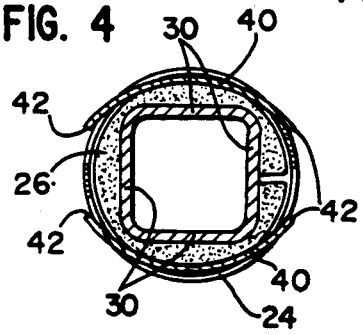
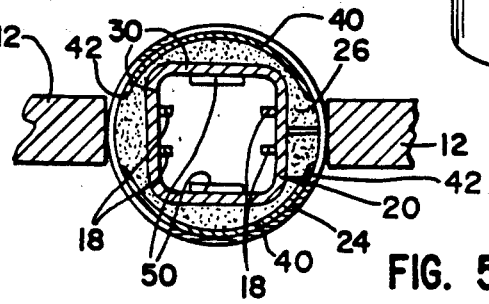
FIG. 5

FIXTURE-MOUNTING POST AND ASSEMBLY METHOD THEREFOR

TECHNICAL FIELD OF THE INVENTION

This invention pertains to a fixture-mounting post assembled in an improved way and useful to mount one or more fixtures.

BACKGROUND OF THE INVENTION

In commercial establishments, such as clothing and other retail stores, it is common to mount fixtures of various types on floor-anchored posts.

In one known arrangement, each post comprises an inner, elongate member and an outer shroud. The elongate member is made from a length of substantially square metal tubing with two oppositely facing longitudinal arrays of slots extending through flat walls of such member. The slots are configured to receive hooks on the fixture. The shroud is made from two similar pieces of sheet metal.

At the upper end of the shroud, a hook welded to an inner surface of each of the shroud pieces is hooked over one of the walls of the inner member. A metal sleeve is fitted over the lower ends of the shroud pieces, which are spaced from each other to permit access to the longitudinal arrays of fixture-mounting slots. The shroud pieces are welded to the sleeve.

Because the shroud pieces are welded to the sleeve, the shroud pieces cannot be pre-finished with an applied coating that can be damaged by heat from welding. Moreover, welding of the shroud pieces to the sleeve is an expensive, time-consuming task.

Hence, there has been a need, to which this invention is addressed, for a better way to assemble a fixture-mounting post.

SUMMARY OF THE INVENTION

This invention provides a fixture-mounting post assembled in an improved way. Although the fixture-mounting post is assembled from components similar to components used in the known arrangement noted above, along with one new component noted below, welding is not required as has been the case in the past.

Broadly, the fixture-mounting post comprises an elongate member, an elongate shroud, a sleeve, and resiliently compressible means.

The elongate member defines at least one mounting means, which may comprise a slot or a longitudinal array of slots for mounting at least one fixture. The shroud is disposed substantially around the elongate member. The shroud has at least one pair of elongate edges extending to at least one end. The edges are separated from each other to permit access to the mounting means. A sleeve encloses a portion of the shroud at the same end.

The resiliently compressible means is compressed between the elongate member and enclosed portion of the shroud. The resiliently compressible means presses the enclosed portion of the shroud outwardly to effect a tight fit between the enclosed portion of the shroud and the sleeve.

Preferably, the resiliently compressible means comprises a strip of resiliently compressible material disposed at least partly around the elongate member. One example of suitable material is synthetic rubber foam used commonly for weatherstripping. Such weatherstripping material may be adhesively affixed to and around the elongate member. Other resiliently compressible materials may be alternatively used.

The elongate member may comprise a length of tubing, such as substantially square or other substantially rectangular tubing having flat walls. Substantially square metal tubing is preferred. Thus, each mounting means may comprise a slot extending through one of such walls, or a longitudinal array of such slots.

It is preferred that the elongate member defines two oppositely facing mounting means, each for mounting at least one fixture. Moreover, it is preferred that, for each mounting means, the shroud has a pair of elongate edges extending to the end enclosed by the sleeve and being separated from each other to provide access to such mounting means. Such edges may extend also to the opposite end of the shroud.

In a preferred arrangement, the elongate edges extend to both ends of the shroud, which is made in two separate portions. The shroud portions are assembled to the elongate member by means of the sleeve and the resiliently compressible means. There is no need to weld the shroud portions to the sleeve.

The shroud portions may be also fastened to the elongate member near the opposite end of the shroud. If the elongate member comprises a length of tubing, the shroud portions may be thus fastened by means of hooks attached to the shroud portions and configured to hook over the elongate member.

This invention also provides a method of assembling a fixture-mounting post from an elongate member, shroud, and sleeve, and a resiliently compressible means.

Initially, the resiliently compressible means is disposed against the elongate member near one end. If a strip of resiliently compressible material is used, the strip is wrapped at least partly around such member. Next, the shroud is disposed substantially around the elongate member, and around the resiliently compressible means, so that the compressible means is disposed therebetween. p The sleeve is then placed over the end of the shroud adjacent the compressible means. Thus, the sleeve encloses a portion of the shroud and the resilient compressible means is compressed between the elongate member and the enclosed portion of the shroud. Consequently, a tight fit is effected between the enclosed portion of the shroud and the sleeve and the shroud and sleeve are frictionally secured to each other.

The method may be advantageously practiced if the shroud comprises two separate portions, and may be enhanced by fastening the shroud portions to the elongate member, near the opposite end of the shroud as by hooks attached to the shroud portions and configured to hook over the elongate member.

Hence, this invention provides a better way to assemble a fixture-mounting post. Because there is no need to weld the shroud to the sleeve, the shroud can be pre-finished with an applied coating that could have been damaged, as by heat from welding. Thus the total time required to produce the fixture-mounting post can be greatly reduced.

These and other objects, features, and advantages of this invention will be evident from the following description of a presently preferred embodiment of this invention and accompanying drawings.

BRIEF DESCRIPTION OF THE DRAWINGS

FIG. 1 is a partly exploded, perspective view of a fixture-mounting post according to this invention, along with two fixtures and a mounting plate.

FIG. 2 is a further exploded, perspective view of the post of FIG. 1.

FIG. 3, on a somewhat reduced scale, is a partly assembled, perspective view of the post of FIGS. 1 and 2.

FIG. 4, on an enlarged scale, is a cross-sectional view taken along line 4—4 of FIG. 3, in a direction indicated by arrows.

FIG. 5, on an enlarged scale, is a cross-sectional view taken along line 5—5 after the post of FIGS. 1 through 4 has been assembled and the fixtures of FIG. 1 have been mounted.

DETAILED DESCRIPTION OF PREFERRED EMBODIMENT

A presently preferred embodiment of this invention is illustrated in the drawings and will be hereinafter described. It should be understood, however, that this invention is not limited to any particular embodiment.

As shown in the drawing, a fixture-mounting post 10 constituting a presently preferred embodiment of this invention is being used to mount two fixtures 12. One such fixture 12 is shown in FIG. 1 as mounted to the post 10. The other fixture 12 is shown in FIG. 1 as about to be so mounted. The post 10 is shown in FIG. 1 as mounted to a floor 14 in a manner to be later described.

Although the fixtures 12 are shown as comprising vertical panels, each being equipped with a pair of upper hooks 16 and a pair of lower hooks 18, it should be understood that the fixtures 12 are intended to be merely representative of a variety of known fixtures that can be similarly mounted on the post 10. Details of such fixtures, therefore, are outside the scope of this invention.

Broadly, the post 10 comprises an elongate member 20, an elongate shroud 22, and a sleeve 24, along with a strip 26 of resiliently compressible material. The strip 26 enables the post 10 to be securely assembled without welding.

The member 20 is made from substantially square metal tubing having flat walls 30 and cut to an arbitrary length. On two opposite walls 30, the member 20 defines two oppositely facing fixture-mounting means. Each fixture-mounting means is adapted to mount at least one fixture, such as one of the fixtures 12. Each fixture-mounting means comprises a longitudinal array of paired slots 32 extending through one of the opposite walls 30. The remaining walls 30 do not have such slots. The slots 32 are configured to receive hooks like the upper and lower hooks with which the fixtures 12 are equipped. When the fixtures 12 are mounted to the post 10, the upper hooks 16 are hooked into upper slots 32, and the lower hooks 18 are hooked into lower slots 32.

The shroud 22 is made from sheet metal in two similar portions or pieces 40 curved to conform generally to a circular cylinder. The shroud pieces 40 may be prefinished with an applied coating by spray painting, electrostatic finishing, or any other finishing technique known to the art. The shroud pieces 40 are substantially as long as the member 20 and define two pairs of elongate edges 42 extending to the upper and lower ends of the shroud pieces 40. The shroud pieces 40 are disposed in such a manner that the paired edges 42 are separated to permit access to slots 32 in each array.

Mounting hooks 50 are welded to inner surfaces of the shroud pieces 40, one being welded to each shroud piece 40, near its upper end 52, and about halfway between its elongate edges 42. The mounting hooks 50 are configured to hook over the upper end 54 of the member 20, at the two unslotted opposite walls 30, so that the upper ends 52 of the shroud pieces 40 are fastened to the upper end 54 of the member 20.

The strip 26 of resiliently compressible material is a strip of synthetic rubber foam, such as foam used commonly for weatherstripping. The strip 26 has an adhesive surface 60 covered initially with a removable strip 62 of protective film that can be easily peeled away to expose the adhesive surface 60. Suitable weatherstripping material with such an adhesive surface is available as a foam rubber of medium density and may be about ¾ inch by ½ inch in cross section. Other suitable resiliently compressible materials or foam or the like may be alternatively used.

The strip 26 may be substantially rectangular in cross-section, as shown, and is sufficiently long to permit it to be wrapped at least partly around and preferably substantially entirely around the member 20. After the removable strip 62 of protective film has been peeled away, the strip 26 is wrapped substantially around the member 20, near its lower end 68, with the adhesive surface 60 facing the member 20. The strip 26 is affixed to the member 20 via the adhesive surface 60.

The sleeve 24, which comprises a length of circular metal tubing, is shorter than the member 20 and the shroud portions 40.

After the shroud pieces 40 have been disposed properly over the strip 26, the sleeve 24 is placed over the lower ends 68 of the shroud pieces 40. A clamp (not shown) conforming generally to the shroud pieces 40 may be temporarily used to clamp the shroud pieces 40 and to compress the foam strip 26 while the sleeve 24 is being placed over the ends of the shroud pieces. Clamping may occur by squeezing in the direction of the arrows in FIG. 3. A mallet (not shown) having a wooden or hard rubber head may be then used to drive the sleeve 24 along the lower ends 68 of the shroud pieces 40 for a sufficient distance to provide a secure assembly. As such, the sleeve 24 encloses portions of the edges 42 where the edges 42 extend to the lower ends 68 of the shroud pieces 40. As so assembled, the strip 26 of resiliently compressible material is compressed between the member 20 and the enclosed portions of the shroud pieces 40 and a tight, secure fit is effected between the sleeve 24 and those portions of the shroud pieces 40, without welding or other mechanical attachment.

As shown in FIGS. 1 and 2, a mounting plate 70 having a square, upright spigot 74 welded thereto is used to mount the post 10 to the floor 14. The spigot 74 is dimensioned to slip into the square tubing comprising member 20 and is complementary in size thereto to coact with member 20 to prevent the post 10 from rotating about the spigot 74. Conventional fasteners 76 coacting with suitable holes 78 (one shown) in the mounting plate 70 anchor the mounting plate 70 to the floor 14. The post 10 is placed on the mounting plate 70 so that the upright spigot 74 extends into the lower end 64 of the member 20.

Also, the post 10 may be stabilized against vertical movement, as by being fastened to a ceiling (not shown) in a known manner. Thus, a wooden plug (not shown)

of a known type may be secured in the upper end 54 of the member 20, between the hooks 50, to facilitate fastening the post 10 to the ceiling.

A preferred method for assembling the fixture-mounting post 10 from the member 20, the shroud pieces 40, the sleeve 24, and the strip 26 of resiliently compressible material will be next described.

After the removable strip 62 of protective film has been pulled away to expose the adhesive surface 60, the strip 62 of resiliently compressible material is wrapped substantially around the member 20, near its lower end 64, and the strip 26 is affixed to the member 20 via the adhesive surface 60.

Next, the hooks 50 are hooked over the upper end 54 of the member 20, at the opposite walls 30 without slots 32, so that the upper ends 52 of the shroud pieces 40 are fastened to the upper end 54 of the member 20. Accordingly, the shroud pieces 40 are disposed substantially around the member 20 in such a manner that the paired edges 42 are separated to permit access to the slots 32 in each array.

Then, the sleeve 24 is placed over the lower ends 68 of the shroud pieces 40 so that the sleeve 24 encloses portions of the shroud pieces 40 near their lower ends 68. The shroud pieces 40 may be temporarily clamped to assist in compressing the foam strip, while the sleeve 24 is being moved to its final position.

Since the strip 26 of resiliently compressible material is compressed between the member 20 and the enclosed portions of the shroud pieces 40, a tight fit is effected between the sleeve 24 and those portions of the shroud pieces 40. Thus, there is no need to weld or otherwise secure the shroud pieces 40 to the sleeve 24.

Various modifications may be made to the fixture-mounting post 10, and to the preferred method described above for its assembly, without departing from the scope and spirit of this invention.

I claim:

1. A fixture-mounting post for mounting one or more fixtures, said post comprising (a) an elongate member defining at least one mounting means for mounting at least one fixture, (b) an elongate shroud having opposite ends and being disposed around said member, said shroud having at least one pair of elongate edges extending to at least one of said ends, said edges being separated from each other to permit access to said mounting means, (c) a sleeve enclosing a portion of said shroud at said one end, and (d) resiliently compressible means compressed between said member and the enclosed portion of said shroud for pressing said enclosed portion outwardly to effect tight fit between said enclosed portion and said sleeve.

2. The fixture-mounting post of claim 1 wherein said resiliently compressible means comprises a strip of resiliently compressible material disposed at least partly around said member.

3. The fixture-mounting post of claim 2 wherein said strip is affixed to said member.

4. The fixture-mounting post of claim 3 wherein said strip is affixed adhesively to said member.

5. The fixture-mounting post of claim 2 wherein the elongate member comprises a length of substantially rectangular tubing having flat walls, said mounting means comprising at least one slot extending through one of said walls.

6. The fixture-mounting post of claim 5 wherein said mounting means comprises a longitudinal array of said slots extending through one of said walls.

7. The fixture-mounting post of claim 2 wherein the elongate member defines two said mounting means facing oppositely and wherein, for each one of said mounting means, said shroud has two elongate edges extending to at least said one end and being separated from each other to provide access to such one of said mounting means.

8. The fixture-mounting post of claim 7 wherein the elongate member comprises a length of substantially square tubing having flat walls, said mounting means comprising longitudinal arrays of slots extending through opposite ones of said walls, said resiliently compressible means comprising a strip of resiliently compressible material disposed at least partly around said member.

9. The fixture-mounting post of claim 7 wherein said edges extend to both of said ends, said shroud comprising two separate portions assembled to said member by means of said sleeve and said resiliently compressible means.

10. The fixture-mounting post of claim 9 comprising fastening means for fastening said shroud portions to said member near the opposite end of said shroud.

11. The fixture-mounting post of claim 10 wherein said fastening means comprises hooks attached to said shroud portions and configured to hook over said member at said opposite end of said shroud.

12. A method for assembling a fixture-mounting post useful to mount one or more fixtures, said method comprising the steps of (a) providing an elongate member defining at least one mounting means for mounting at least one fixture, (b) disposing resiliently compressible means against said member near one end of said member, (c) disposing an elongate shroud around said member so that said resiliently compressible means is disposed between said member and said shroud, said shroud having edge portions being separated to permit access to said mounting means, and (d) placing a sleeve over said one end of said shroud to enclose a portion of the shroud and to compress said resiliently compressible means between said member and the enclosed portion of said shroud, thereby to effect a tight fit between said shroud and said sleeve to secure said shroud to said sleeve.

13. The method of claim 12 wherein said resiliently compressible means comprises a strip of resiliently compressible material and wherein step (b) comprises wrapping said strip at least partly around said member.

14. The method of claim 13 wherein step (b) further includes affixing said strip to said member.

15. The method of claim 14 wherein step (b) further includes adhesively affixing said strip to said

16. The method of claim 13 and further comprising the step of clamping said shroud to compress said compressible means to facilitate placing said sleeve over said one end of said shroud.

17. The method for assembling a fixture-mounting post useful to mount one or more fixtures, said method comprising the steps of (a) providing an elongate member comprising a length of substantially square tubing with flat walls and defining two oppositely facing mounting means, each for mounting at least one fixture and each comprising a longitudinal array of slots extending through a respective one of said walls, (b) disposing resiliently compressible means against said member near one end of said member, (c) disposing an elongate shroud comprising two separate shroud portions around said member so that said resiliently compressible means is disposed between said member and said shroud portions, said shroud portions defining, for each said mounting means, a pair of elongate edges extending to at least one end of each said shroud portion, said edges being separated to permit access to said mounting means, and (d) placing a sleeve over said one end to enclose portions of said shroud portions and to compress said resiliently compressible means between said member and said enclosed portions, said enclosed portions including portions of said edges extending to said one end of each said shroud portion, thereby to effect a tight fit between said enclosed portions and said sleeve and to secure said shroud to said sleeve.

18. The method of claim 17 wherein said resiliently compressible means comprises a strip of resiliently compressible material and wherein step (b) comprises wrapping said strip at least partly around said member near said one end of said member.

19. The method of claim !8 wherein step (b) further includes affixing said strip to said member.

20. The method of claim 19 wherein step (b) includes adhesively affixing said strip to said member.

21. The method of claim 17 comprising the step of fastening said shroud portions to said member near the other end of said member.

22. The method of claim 21 wherein the elongate member comprises a length of tubing and wherein said fastening step comprises fastening said shroud portions to said member by means of hooks attached to said shroud portions and configured to hook over said member at said other end.

23. The method claim 17, and further comprising the step of clamping said shroud to compress said compressible means to facilitate placing said sleeve over said one end of said shroud.

* * * * *

UNITED STATES PATENT AND TRADEMARK OFFICE

CERTIFICATE OF CORRECTION

PATENT NO. : 5,004,198

DATED : April 2, 1991

INVENTOR(S) : Paul A. Jager

It is certified that error appears in the above-identified patent and that said Letters Patent is hereby corrected as shown below:

TITLE PAGE

IN THE ABSTRACT:

In the fifth line, delete "protions" and insert --portions--.

IN THE CLAIMS:

Column 6, line 57, insert --member.-- after "to said".

Signed and Sealed this

Twenty-fifth Day of August, 1992

*Attest:*

DOUGLAS B. COMER

*Attesting Officer*

*Acting Commissioner of Patents and Trademarks*